United States Patent [19]

Kimura et al.

[11] 4,307,978

[45] Dec. 29, 1981

[54] METHOD OF RELIEVING EARTH PRESSURE IN A WORKING AREA

[75] Inventors: Osamu Kimura, Ohmutashi; Hiroshi Kuroda, Tokyo, both of Japan

[73] Assignee: Mitsui Sekitan Kogyo Kabushiki Kaisha, Nihonbashi, Japan

[21] Appl. No.: 94,975

[22] Filed: Nov. 16, 1979

[30] Foreign Application Priority Data

Nov. 30, 1978 [JP] Japan ..... 53-148465

[51] Int. Cl.[3] ..... E21F 17/00

[52] U.S. Cl. ..... 405/258; 299/11

[58] Field of Search ..... 405/258, 259; 299/11, 299/13, 16, 20

[56] References Cited

U.S. PATENT DOCUMENTS

| | | | |
|---|---|---|---|
| 999,000 | 7/1911 | Trippe | 299/16 X |
| 3,026,096 | 3/1962 | Love | 299/11 |
| 3,097,830 | 7/1963 | Love et al. | 299/11 |
| 3,384,416 | 5/1968 | Ruehl et al. | 299/16 |
| 3,673,807 | 7/1972 | Serata | 299/11 X |
| 4,017,121 | 4/1977 | Trent | 299/16 X |
| 4,084,384 | 4/1978 | Serata | 405/260 X |

*Primary Examiner*—Dennis L. Taylor

*Attorney, Agent, or Firm*—Oldham, Oldham, Hudak & Weber Co.

[57] ABSTRACT

The earth pressure in the underground working area is effectively alleviated by injecting high-pressure liquid into a weak ground stratum underlying the ore bed being excavated thereby to enlarge the stress envelope formed around the working face. The liquid injection hole is formed as by drill means to extend from the working face or a neighboring gateway through an intermediate layer into the weak stratum preferably at a point outside of the stress envelope initially formed.

5 Claims, 4 Drawing Figures

METHOD OF RELIEVING EARTH PRESSURE IN A WORKING AREA

BACKGROUND AND SUMMARY OF THE INVENTION

This invention relates to methods of relieving the earth pressure in a working area in an underground coal or other mins.

For example, in longwall coal mining, are excessively large earth pressure is often met in the vicinity of a working area particularly in cases where the working depth from surface is substantially increased and may possibly cause bulging collapse of the coal face, which seriously impairs the mining efficiency. In coping with such situations, it has been usual to take measures such as of increasing the pressure-bearing capacity of the support structure, adding protecting devices thereto, or restricting entrance of miners to the working area for mining safety.

Under the circumstances, the present invention is intended to make any measures conventionally taken for prevention of such face bulging collapse as described above substantially needless or at least to minimize the need for taking the conventional preventive measures.

According to the present invention, there is provided a new method of relieving the earth pressure around a working area, which is applicable to underground excavation of ore deposits under which a weak stratum lies and which comprises injecting high-pressure liquid into the underlying weak stratum to enlarge the stress envelope formed around the working area thereby to alleviate the earth pressure at the working face.

The above and other objects, features and advantages of the present invention will become apparent from the following description when taken in conjunction with the accompanying drawing.

DESCRIPTION OF THE PREFERRED EMBODIMENTS

Figure 1:
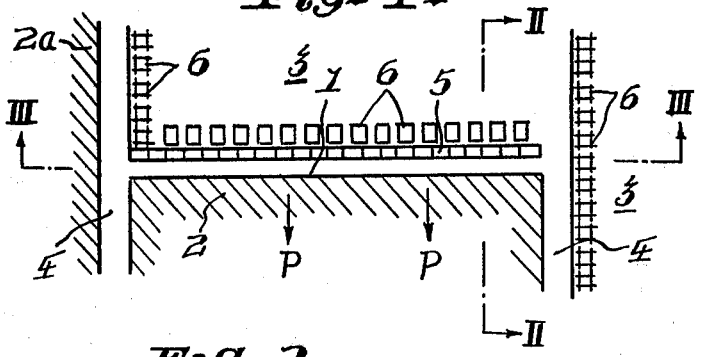
FIG. 1 is a plan view, in longitudinal cross section, illustrating a working area embodying the earth-pressure relieving method of the present invention.
Figure 2:
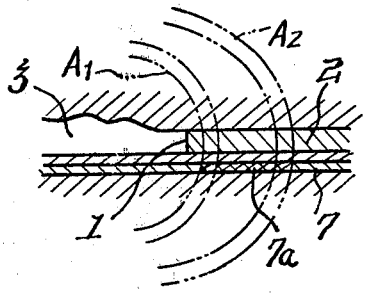
FIG. 2 is a cross-sectional view taken along the line II—II in FIG. 1.
Figure 3:
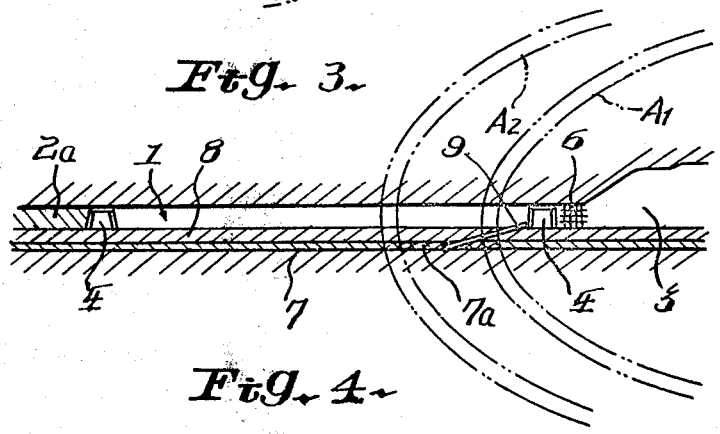
FIG. 3 is a cross-sectional elevation taken along the line III—III in FIG. 1.

Referring first to FIGS. 1 to 3, which illustrate a longwall coal mining face embodying the method of the present invention, reference numeral 1 designates the working face of a useful ore bed or coal seam 2 which is being excavated in the direction of the arrows P; 3 designates mined-out openings formed behind and on one side of the working face; 4 designates face gateways; 5 designates a face conveyor; and 6 designates roof supports. In such working area, there develops a stress envelope $A_1$ such as indicated by the chaindotted lines in FIGS. 2 and 3 because of the presence of mined-out openings 3. As is well known, the stress envelope $A_1$ represents the zone of high stress concentration formed around the underground cavity or opening under earth pressure and is responsible for the occurrence of bulging collapse at the working face 1 while on the other hand giving rise to unwanted pressure forces acting upon the mining machines in use. In the example illustrated, the mined-out areas 3 are left unfilled, allowing the overlying strata to collapse and, as with the case of this example, even in cases where the mined-out areas are filled as excavation proceeds, the balance of earth pressure must be more or less broken as compared to the state of stress before excavation and there exists at all times at least a minimum of open space for working along the ore face. On account of these facts, the stress envelope must be substantially limited in radius of curvature irrespective of whether the mined-out areas are immediately filled or left unfilled.

The earth-pressure relieving method of the present invention is applicable to working faces such as described above and particularly to those for excavation of an ore bed 2 with an underlying weak stratum 7. Specifically, as shown in FIG. 3, an injection hole 9 is formed as by drill means which extends from the working face 1 or the neighboring face gateway 4 into that region of the weak stratum 7, which lies under the useful ore bed 2 such as a coal seam, through an intermediate stratum 8 lying between the ore bed and the weak stratum. Through the injection hole 9, high-pressure liquid of low cost such as pressure water is injected to break a portion 7*a* of the weak stratum 7. As a result, the pressure in the portion 7*a* is dispersed radially outwardly of the void or opening 3; in other words, the stress envelope A, initially formed is enlarged or bulged outwardly into a position indicated by the chain-dotted lines $A_2$. Accordingly, the earth pressure at the working face 1 is widely reduced and the danger of its bulging collapse is eliminated. In this connection, it is desirable that the injection hole 9 is formed so that its forward end reaches the weak stratum 7 at a point outside of the initial stress envelope $A_1$. This hole positioning not only enables the high-pressure liquid to be injected free from the influence of any earth pressure of the stress envelope $A_1$ but enables it to be dispersed within the weak stratum 7 with greater ease.

Figure 4:
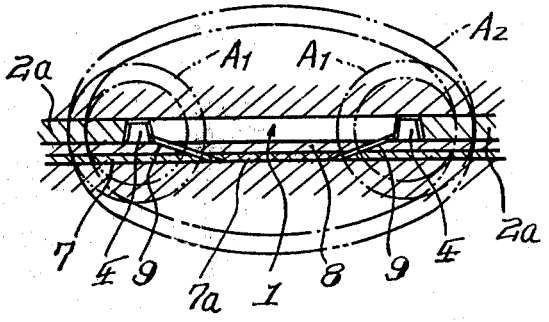
FIG. 4 is a transverse cross-sectional elevation illustrating another example of working area embodying the present invention.

Referring next to FIG. 4, the working face shown therein lies between unmined ore bed portions 2*a* that remain on the opposite sides of the face working space 1 whereas with the case of FIGS. 1 to 3 the ore bed is left unexcavated only on one side of the face working space 1 as at 2*a*. In this case of FIG. 4, two stress envelopes are formed prior to the injection of high-pressure liquid one around each of the opposite ends of the working space 1 as indicated by the chain-dotted lines $A_1$. These primary stress envelopes are enlarged to be transformed into a single secondary stress envelope $A_2$ by injecting high-pressure liquid into substantially the whole of that region of weak stratum 7 which extends between the two opposite gateways 4. In FIG. 4, the same reference numerals have been used as in FIGS. 1 to 3 for similar parts for the sake of clarity. As will be apparent from the foregoing description, the position of pressure liquid injection into the weak stratum 7 is freely determined in accordance with the position and shape of stress envelopes as supposed to develop, which are more or less different with different face formations.

To summarize, according to the earth-pressure relieving method of the present invention, the earth pressure around an underground working face 1 is radically alleviated simply by injection of high-pressure liquid so that not only bulging collapse at the working face can be prevented practically completely but the load on ground supports and the rock resistance to excavation by mining machinery are materially reduced. It will thus be readily appreciated that the method of the present invention is highly valuable for mining safety and for improvement in efficiency of underground mining operations.

What is claimed is:

1. In the mining of underground ore deposits, a method of relieving the earth pressure in a working are which comprises injecting high-pressure liquid into a weak stratum (7) lying under the useful ore bed (2) to enlarge the stress envelope ($A_1$) formed around the working area thereby to alleviate the earth pressure around the working face (1) and said high-pressure liquid being injected into said weak stratum at a point outside of the initial stress envelope ($A_1$).

2. A method as claimed in claim 1, in which said high-pressure liquid is high-pressure water.

3. A method as claimed in claim 1 or 2, in which said high-pressure liquid is injected through an injection hole (9) bored from the working face or a neighboring gateway into the weak stratum (7) through an intermediate stratum (8) lying between the useful ore bed and the weak stratum.

4. In the mining of underground ore deposits where a working face is formed between two spaced unmined ore portions on opposite sides of the face working space (1) and where two face gateways (4) are formed at the side margins of the working face (1), two initial stress envelopes ($A_1$) being formed in the unmined ore adjacent the face gateways, the method of relieving the earth pressure in a working area which comprises injecting high-pressure liquid into a weak stratum (7) lying under the useful ore bed (2) to combine the stress envelopes ($A_1$) formed around the face gateways thereby to alleviate the earth pressure around the working face (1).

5. A method as claimed in claim 4, in which said high-pressure liquid is injected through injection holes (9) bored from the working face or a neighboring gateway into the weak stratum (7) from areas outside of the initial stress envelopes.

* * * * *